US009896908B2

(12) United States Patent
Harris et al.

(10) Patent No.: US 9,896,908 B2
(45) Date of Patent: Feb. 20, 2018

(54) WELL BORE STIMULATION VALVE

(71) Applicant: Team Oil Tools LP, The Woodlands, TX (US)

(72) Inventors: Michael J. Harris, Houston, TX (US); Kenneth J. Anton, Houston, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 704 days.

(21) Appl. No.: 14/290,410

(22) Filed: May 29, 2014

(65) Prior Publication Data

US 2015/0000921 A1 Jan. 1, 2015

Related U.S. Application Data

(63) Continuation-in-part of application No. 14/229,362, filed on Mar. 28, 2014, now Pat. No. 8,863,853, which is a continuation-in-part of application No. 13/987,053, filed on Jun. 28, 2013, now Pat. No. 9,458,698.

(51) Int. Cl.

| | |
|---|---|
| ***E21B 34/14*** | (2006.01) |
| *E21B 43/26* | (2006.01) |
| *E21B 34/00* | (2006.01) |

(52) U.S. Cl.

CPC ..... *E21B 34/14* (2013.01); *E21B 43/26* (2013.01); *E21B 2034/007* (2013.01)

(58) Field of Classification Search

CPC ..... E21B 34/14; E21B 2034/007; E21B 43/26

See application file for complete search history.

(56) References Cited

U.S. PATENT DOCUMENTS

| | | | |
|---|---|---|---|
| 3,011,548 | A | 7/1958 | Holt |
| 4,893,678 | A | 1/1990 | Stokley et al. |

(Continued)

FOREIGN PATENT DOCUMENTS

| | | |
|---|---|---|
| EP | 0198406 A1 | 10/1986 |
| GB | 1359961 | 7/1974 |

(Continued)

OTHER PUBLICATIONS

*Examiner's Report*, Canadian Ser. No. 2,855,083, dated Nov. 6, 2015.

(Continued)

*Primary Examiner* — Blake E Michener

(74) *Attorney, Agent, or Firm* — MH2 Technology Law Group, LLP

(57) ABSTRACT

Stimulation valves for a well tubular having a cylindrical housing adapted for assembly into a tubular for a well. The valves have ports allowing fluid communication between a central conduit and the exterior of the housing and a valve body adapted for movement from a closed position to an open position allowing fluid communication through the ports. A ball seat is mounted in the valve conduit above the ports. The ball seat has an initial ball-catch state in which a ball may be received in the ball seat to move the valve body from its closed position to its open position. The ball seat is adapted to transition to a ball-pass state and release the ball as the valve body is moved to the open position. The ball seat remains in the ball-pass state after the transition from the ball-catch state.

25 Claims, 3 Drawing Sheets

(56) References Cited

U.S. PATENT DOCUMENTS

| | | | |
|---|---|---|---|
| 5,058,671 | A | 10/1991 | Cochran |
| 5,375,662 | A | 12/1994 | Echols et al. |
| 5,806,596 | A | 9/1998 | Hardy et al. |
| 5,810,084 | A | 9/1998 | Echols |
| 6,059,032 | A | 5/2000 | Jones |
| 6,634,428 | B2 | 10/2003 | Krauss et al. |
| 6,866,100 | B2 | 3/2005 | Gudmestad et al. |
| 6,907,936 | B2 | 6/2005 | Fehr et al. |
| 7,108,067 | B2 | 9/2006 | Themig et al. |
| 7,322,417 | B2 | 1/2008 | Rytlewski et al. |
| 7,325,616 | B2 | 2/2008 | Lopez de Cardenas |
| 7,377,321 | B2 | 5/2008 | Rytlewski |
| 7,387,165 | B2 | 6/2008 | Lopez de Cardenas et al. |
| 7,416,029 | B2 | 8/2008 | Telfer et al. |
| 7,581,596 | B2 | 9/2009 | Reimert et al. |
| 7,644,772 | B2 | 1/2010 | Avant et al. |
| 7,661,478 | B2 | 2/2010 | Palmer et al. |
| 8,181,701 | B2 | 5/2012 | Yokley et al. |
| 8,261,761 | B2 | 9/2012 | Gerrad et al. |
| 8,276,674 | B2 | 10/2012 | Lopez de Cardenas et al. |
| 8,291,988 | B2 | 10/2012 | King |
| 8,443,984 | B2 | 5/2013 | Coghill et al. |
| 8,479,808 | B2 | 7/2013 | Gouthaman |
| 8,505,632 | B2 | 8/2013 | Guerrero et al. |
| 8,522,885 | B2 | 9/2013 | Giroux et al. |
| 8,668,006 | B2 | 3/2014 | Xu |
| 8,789,600 | B2 | 7/2014 | O'Connell et al. |
| 9,097,079 | B2 | 8/2015 | Themig |
| 2001/0045288 | A1 | 11/2001 | Allamon et al. |
| 2003/0136563 | A1 | 7/2003 | Allamon et al. |
| 2004/0035586 | A1 | 2/2004 | Gudmestad et al. |
| 2004/0045714 | A1 | 3/2004 | McGavern, III et al. |
| 2004/0069496 | A1 | 4/2004 | Hosie et al. |
| 2004/0108109 | A1 | 6/2004 | Allamon et al. |
| 2004/0118564 | A1 | 6/2004 | Themig et al. |
| 2004/0154839 | A1 | 8/2004 | McGarian et al. |
| 2007/0272411 | A1 | 11/2007 | Lopez de Cardenas et al. |
| 2008/0093080 | A1 | 4/2008 | Palmer et al. |
| 2009/0011247 | A1* | 1/2009 | Barlow ..... B29C 70/085 428/413 |
| 2009/0084553 | A1 | 4/2009 | Rytlewski et al. |
| 2009/0308588 | A1 | 12/2009 | Howell et al. |
| 2010/0243254 | A1 | 9/2010 | Murphy et al. |
| 2010/0270030 | A1 | 10/2010 | Ashy et al. |
| 2011/0192607 | A1 | 8/2011 | Hofman et al. |
| 2011/0203800 | A1 | 8/2011 | Tinker et al. |
| 2011/0240301 | A1 | 10/2011 | Robison et al. |
| 2011/0278017 | A1 | 11/2011 | Themig et al. |
| 2011/0315390 | A1* | 12/2011 | Guillory ..... E21B 21/103 166/329 |
| 2012/0073828 | A1 | 3/2012 | Churchill |
| 2012/0168163 | A1 | 7/2012 | Bertoja et al. |
| 2012/0199341 | A1 | 8/2012 | Kellner et al. |
| 2012/0199349 | A1 | 8/2012 | Themig et al. |
| 2012/0205121 | A1* | 8/2012 | Porter ..... E21B 34/14 166/373 |
| 2012/0261131 | A1 | 10/2012 | Hofman et al. |
| 2013/0025868 | A1 | 1/2013 | Smith et al. |
| 2013/0025876 | A1 | 1/2013 | McCoy et al. |
| 2013/0048273 | A1 | 2/2013 | Crow et al. |
| 2013/0068475 | A1 | 3/2013 | Hofman et al. |
| 2013/0118732 | A1 | 5/2013 | Chauffe et al. |
| 2013/0153220 | A1 | 6/2013 | Carter et al. |
| 2013/0255963 | A1 | 10/2013 | Guerrero et al. |
| 2013/0299199 | A1 | 11/2013 | Naedler et al. |
| 2014/0352970 | A1* | 12/2014 | Kristoffer ..... E21B 43/12 166/318 |

FOREIGN PATENT DOCUMENTS

| | | | |
|---|---|---|---|
| GB | 2323871 | A | 10/1998 |
| GB | 2389608 | A | 12/2003 |
| WO | 1996/034176 | A2 | 10/1996 |
| WO | 1996/034176 | A3 | 10/1996 |
| WO | 2001/04457 | A1 | 1/2001 |
| WO | 2001/90529 | A1 | 11/2001 |
| WO | 2002/14650 | A1 | 2/2002 |
| WO | 2002/061236 | A1 | 8/2002 |
| WO | 2004/031533 | A2 | 4/2004 |
| WO | 2004/031533 | A3 | 4/2004 |
| WO | 2004/083590 | A2 | 9/2004 |
| WO | 2004/083590 | A3 | 9/2004 |
| WO | 2004/088091 | A1 | 10/2004 |
| WO | 2005/085584 | A1 | 9/2005 |
| WO | 2006/134446 | A2 | 12/2006 |
| WO | 2006/134446 | A3 | 12/2006 |
| WO | 2010/129678 | A2 | 11/2010 |
| WO | 2014/043806 | A1 | 3/2014 |

OTHER PUBLICATIONS

*Annex to Form PCT/ISA/206 Communication Relating to the Results of the Partial Int'l Search*, PCT Ser. No. PCT/US2015/056342, dated Jan. 27, 2016.

*International Search Report*, Serial No. PCT/US2014/044445 (dated Mar. 16, 2015).

*Written Opinion of the International Searching Authority*, Serial No. PCT/US2014/044445 (dated Mar. 16, 2015).

Baker Hughes, *FracPoint EX-C Frac Sleeve System* (© 2011 Baker Hughes Incorporated).

H. Halvorsen et al., *Practical Aspects of In-situ Ball Seat Milling*, SPE Annual Technical Conference and Exhibition, Oct. 30, to Nov. 2, 2011, Denver, CO (SPE) (abstract).

Halliburton, Horizontal Completion Systems.

M. Dawson et al., *New Setting Technique for Gravel Pack Packers Increases Operational Safety and Reduces Costs*, SPE Asia Pacific Oil and Gas Conference and Exhibition, Sep. 9-11, 2003, Jakarta, Indonesia (SPE) (abstract).

Scheumberger, *Falcon Ball-Actuated Frac Valve* (© 2012 Schlumberger).

Scheumberger, *Falcon Hydraulic-Actuated Frac Valve* (© 2012 Schlumberger).

Weatherford, *Real Results—ZoneSelect i-ball Mald-zone Fracturing Sleeves Isolate. Fracture 6 Lower Horizontal Openhole Sections in Bakken Shale* (© 2012 Weatherford).

Weatherford, *ZoneSelect i-ball Stimulation Sleeve* (© 2013 Weatherford).

* cited by examiner

WELL BORE STIMULATION VALVE

FIELD OF THE INVENTION

The present invention relates to valves used in oil and gas wells and, more particularly to improved sliding sleeve valves and methods of using sliding sleeve valves. The novel valves and methods are particularly suited for use in fracturing hydrocarbon bearing formations and in other methods for simultaneously stimulating production of hydrocarbons in multiple zones in a well bore.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation to create openings through which oil can enter the cased well. Production tubing, valves, and other equipment are installed in the well so that the hydrocarbons may flow in a controlled manner from the formation, into the cased well bore, and through the production tubing up to the surface for storage or transport.

This simplified drilling and completion process, however, is rarely possible in the real world. Hydrocarbon bearing formations may be quite deep or otherwise difficult to access. Thus, many wells today are drilled in stages. An initial section is drilled, cased, and cemented. Drilling then proceeds with a somewhat smaller well bore which is lined with somewhat smaller casings or "liners." The liner is suspended from the original or "host" casing by an anchor or "hanger." A seal also is typically established between the liner and the casing and, like the original casing, the liner is cemented in the well. That process then may be repeated to further extend the well and install additional liners. In essence, then, a modern oil well typically includes a number of tubes wholly or partially within other tubes.

Moreover, hydrocarbons are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

One technique involves drilling a well in a more or less horizontal direction, so that the borehole extends along a formation instead of passing through it. More of the formation is exposed to the borehole, and the average distance hydrocarbons must flow to reach the well is decreased. Another technique involves creating fractures in a formation which will allow hydrocarbons to flow more easily. Indeed, the combination of horizontal drilling and fracturing, or "frac'ing" or "fracking" as it is known in the industry, is presently the only commercially viable way of producing natural gas from the vast majority of North American gas reserves.

Formations are fractured most commonly by pumping a fluid, usually water, into the formation at high pressure and flow rates. The fluid will cause the formation to fracture and create flow paths to the well. Proppants, such as grains of sand, ceramic or other particulates, usually are added to the frac fluid and are carried into the fractures. The proppant serves to prevent fractures from closing when pumping is stopped.

A formation usually is fractured at various locations. The formation is rarely fractured all at once, but multiple locations within the wellbore may be fractured simultaneously. Especially in a typical horizontal well, the formation usually is fractured at a number of different locations or clusters of locations along the bore in a series of operations or stages. For example, an initial stage may fracture the formation near the bottom of a well. The frac job then would be completed by conducting additional fracturing stages in succession up the well, each stage fracturing a particular location or cluster of locations.

Fracturing typically involves installing a production liner in the portion of the well bore which passes through the hydrocarbon bearing formation. In shallow wells, the production liner may actually be the casing suspended from the well surface. In either event, the production liner is provided with openings at predetermined locations along its length. The openings will allow fluid to be diverted from the liner into the formation. They most commonly are provided by perforating the liner, i.e., forming holes through the liner, or by installing a series of valves in the liner.

Frac valves typically include a cylindrical housing that may be threaded into and forms a part of a production liner. The housing defines a central conduit through which frac fluids and other well fluids may flow. Ports are provided in the housing to allow fluid to flow out of the liner and into the formation. The ports may be opened by actuating a sliding sleeve. The sliding sleeves usually are actuated either by creating hydraulic pressure behind the sleeve itself or by dropping a ball on a ball seat which is connected to the sleeve. Hydraulic pressure then is built up behind the ball to actuate the sleeve. Typical multi-stage fracking systems will incorporate both types of valves.

Halliburton's RapidSuite sleeve system and Schlumberger's Falcon series sleeves, for example, utilize a hydraulically actuated "initiator" valve and a series of ball-drop valves. The production liner is provided with a hydraulically actuated sliding sleeve valve which, when the liner is run into the well, will be located near the bottom of the well bore in the first fracture zone. The production liner also includes a series of ball-drop valves which will be positioned in the various other fracture zones extending uphole from the first zone.

A frac job will be initiated by increasing fluid pressure in the production liner. The increasing pressure will actuate the sleeve in the bottom, hydraulic valve, opening the ports and allowing fluid to flow into the first fracture zone. Once the first zone is fractured, a ball is dropped into the well and allowed to land on the ball seat of the ball-drop valve immediately uphole of the first zone. The seated ball isolates the lower portion of the production liner and prevents the flow of additional frac fluid into the first zone. Continued pumping will shift the seat downward, along with the sliding sleeve, opening the ports and allowing fluid to flow into the second fracture zone. The process then is repeated with each ball-drop valve uphole from the second zone until all zones in the formation are fractured.

It will be appreciated that those systems are designed to fracture one zone at a time. Fracturing a single zone in each stage, other factors being equal, can allow for greater control over the process and will require less pumping capacity, especially when the formation is relatively hard and nonporous. On the other hand, for certain formations and well designs, operators may prefer to fracture multiple zones in a single stage. By fracturing clusters of zones in a single stage, the entire formation can be fractured more quickly.

When the well bore will be fractured in clusters, the production liner will incorporate a series of "static" valves, one for each cluster. Many static valves are ball-drop valves similar to the valves discussed above. They incorporate a ball seat that not only enables the valve to be opened, but once opened, allows a ball seated thereon to restrict the flow of fluid through the valve and into downhole zones that have already been fractured. Instead, fluid is forced out of the valve into the adjacent formation so that it may be fractured.

When a cluster of zones will be fractured in a single stage, the production liner also will incorporate one or more cluster valves uphole from each static valve. The cluster valves commonly are ball-drop valves as well. The ball seats in the cluster valves, however, are designed to catch and release a ball. That is, the ball seat has an initial ball-catch state where a ball will lodge against the seat. Once the ball is seated, hydraulic pressure applied above the ball will drive the valve sleeve downward to open the ports. Once the ports are opened, however, the seat will transition to a ball-pass state which releases the ball and allows it to travel through the valve. Once the ball exits the cluster valve, it will travel down the liner to actuate either another cluster valve or the static valve.

Thus, an operator may be able to fracture a number of clustered zones in a single stage. A ball deployed into the liner will travel through each cluster valve in the cluster and open them in succession. It then will land in the static valve at the bottom of the cluster, opening it and forcing fluid to be diverted out of the static valve and all the cluster valves associated with it. By fracturing multiple zones in a single stage, an operator may be able to complete fracturing of the well more quickly and efficiently.

As the number of cluster valves in a cluster is increased, however, ensuring that all valves in a cluster are fully opened may become more problematic. When the top cluster valve is opened, hydraulic fluid is able to begin flowing out of the valve before the lower cluster valves and the bottom static valve are opened. Any diversion of fluid out the top valve will cause the amount of fluid flowing down the liner and the hydraulic pressure in the liner to fluctuate. The next cluster valve opened will present additional paths for fluid to flow out of the liner. Thus, as a ball travels through a set of clustered valves, it may become progressively more difficult to adjust and control pumping of fluid into the liner so as to ensure that all valves in the cluster are opened completely.

The ability to selectively inject fluid into various zones in a well bore is important not only in fracturing, but also in other processes for stimulating hydrocarbon production. Aqueous acids such as hydrochloric acid may be injected into a formation to clean up the formation. Water or other fluids may be injected into a formation from a "stimulation" well to drive hydrocarbons toward a production well. The ability to selectively flow fluids out a series of valves may improve the efficiency and efficacy of those stimulation processes. Moreover, as in fracturing a well, an operator may prefer to stimulate one zone at a time or to stimulate clusters of zones simultaneously.

Additionally, as a liner incorporates more ball-drop valves, the valves may incorporate ball seats of progressively smaller sizes which can significantly restrict the flow of production fluids up through the liner. Thus, operators may prefer to drill out ball seats in ball-drop valves after a formation has been fractured or otherwise stimulated.

The statements in this section are intended to provide background information related to the invention disclosed and claimed herein. Such information may or may not constitute prior art. It will be appreciated from the foregoing, however, that there remains a need for new and improved sliding sleeve cluster stimulation valves and for new and improved methods for fracking or otherwise stimulating formations using sliding sleeve cluster valves. Such disadvantages and others inherent in the prior art are addressed by various aspects and embodiments of the subject invention.

SUMMARY OF THE INVENTION

The subject invention, in its various aspects and embodiments, is directed generally to valves used in oil and gas wells and, more particularly to improved sliding sleeve valves and methods of using sliding sleeve in fracturing or otherwise stimulating production from hydrocarbon bearing formations. The novel valves and methods are particularly suited for simultaneously fracturing or otherwise stimulating production from multiple zones in a well bore.

One aspect of the invention provides for a stimulation valve for a well tubular. The stimulation valve comprises a cylindrical housing adapted for assembly into a tubular for a well and defines a conduit for passage of fluids through the housing. The housing is provided with one or more ports which allow fluid communication between the conduit and the exterior of the housing. The valve also comprises a valve body, which is adapted for movement from a closed position restricting fluid communication through the ports to an open position allowing fluid communication through the ports, and a ball seat mounted in the valve conduit above the ports. The ball seat has an initial ball-catch state and is operatively connected to the valve body such that a ball may be received in the ball seat to move the valve body from its closed position to its open position. The ball seat also is adapted to transition to a ball-pass state as the valve body is moved from the closed position to the open position whereby the ball may be released from the ball seat after the valve body has moved to its open position. The ball seat will remain in the ball-pass state after the transition from the ball-catch state.

Other aspects provide such valves where the ball seat comprises a split ring with a discontinuous annular body.

The body has a gap therein which allows the split ring to be compressed radially so that the split ring being compressed in the ball-catch state and being expanded in the ball-pass state. The gap may be closed when the split ring is in the compressed state.

Yet other aspects provide such valves where the split ring or other ball seat is mounted in the tool to restrict rotation of the ball seat relative to the tool.

Still other aspects provide such valves where the ball seat is mounted for axial movement from a first position corresponding to the ball-catch state to a second position corresponding to the ball-pass state. The ball seat is operably connected to the valve body such that when the ball seat moves to the second position the valve body moves to the open position.

The subject invention in other embodiments and aspects provides such stimulation valves where the valve has an area of reduced diameter and an area of enlarged diameter and the ball seat comprises a split ring mounted for axial movement from the area of reduced diameter to the area of enlarged diameter. The split ring is compressed by the area of reduced diameter to place the split ring in the ball-catch state and the split ring is allowed to expand into the area of enlarged diameter to place the split ring in the ball-pass state.

Further embodiments provide stimulation valves where the split ring is carried on a drive sleeve engaging the valve sleeve and where the split ring is carried on a drive sleeve under compression. The drive sleeve is mounted for axial movement from a first position to a second position and operably connected to the valve body such that when the drive sleeve moves to the second position the valve body moves to the open position. The movement of the drive sleeve to the second position allows the split ring to expand and release the ball.

Certain aspects provide stimulation valves where the ball seat is fabricated from a molded fiberglass epoxy composite material or another drillable material.

Other aspects provide stimulation valves where the valve body is a sleeve or where the valve comprises a second ball seat mounted below the ports. The second ball seat is adapted to receive a ball to restrict fluid flow through the conduit.

The subject invention in other aspects and embodiments is directed to production liners and other tubulars for oil and gas wells and, especially, tubulars that allow fracturing or other stimulation of a formation after the tubular has been installed. Thus, other embodiments and aspects provide tubulars which are adapted for installation in a well and which comprise the novel stimulation valves in their various aspects and embodiments.

Similarly, further embodiments provide methods of lining a well which comprise installing a tubular which incorporates the novel stimulation valves in their various aspects and embodiments.

Other methods provided by embodiments of the invention are directed to stimulating a formation in a well. Such methods comprise installing a tubular in the well which comprises an uphole stimulation valve and a downhole stimulation valve. The stimulation valves are any of the novel valves in their various aspects and embodiments. A ball then is pumped through the tubular to open both the stimulation valves, and fluid is pumped through the tubular and out the opened stimulation valves to stimulate the formation adjacent both the stimulation valves simultaneously. Preferred embodiments of such methods are directed to fracturing the formation.

Certain other embodiments and aspects of the invention are directed to downhole tools that are adapted for installation into a tubular assembly for a well. Such tools comprise a conduit for passage of fluids through the tool and a ball seat mounted in the tool conduit. The ball seat comprises a split ring which is mounted in the tool to allow the split ring to move between a compressed state, in which the compressed state the split ring provides a seat upon which a ball may be received to restrict passage of fluids through the conduit, and an expanded state, in which the expanded state the split ring allows the ball to pass through the split ring. The split ring is mounted in the tool to restrict rotation of the split ring relative to the tool.

Other aspects provide such tools where the split ring comprises a discontinuous annular body having a gap therein which allows the split ring to be compressed radially.

Still other aspects provide such tools where the split ring comprises a profile extending from the split ring. The profile being adapted to bear on the tool and restrict rotation of the split ring relative to the tool when the split ring is subjected to rotational force.

Yet other embodiments provide such tools where the split ring comprises a discontinuous annular body having a profile extending therefrom. The profile is adapted to restrict rotation of the split ring relative to the tool. Such profiles include a tab which engages a tool component such that interference between the tab and the tool component restricts the split ring from rotating relative to the tool and which have a first portion extending in a first direction so as to restrict rotation of the split ring relative to the tool and a second portion extending in a second direction to restrict axial movement of the split ring relative to a tool component.

Another aspect provides such tools where the split ring is fabricated from a drillable material.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
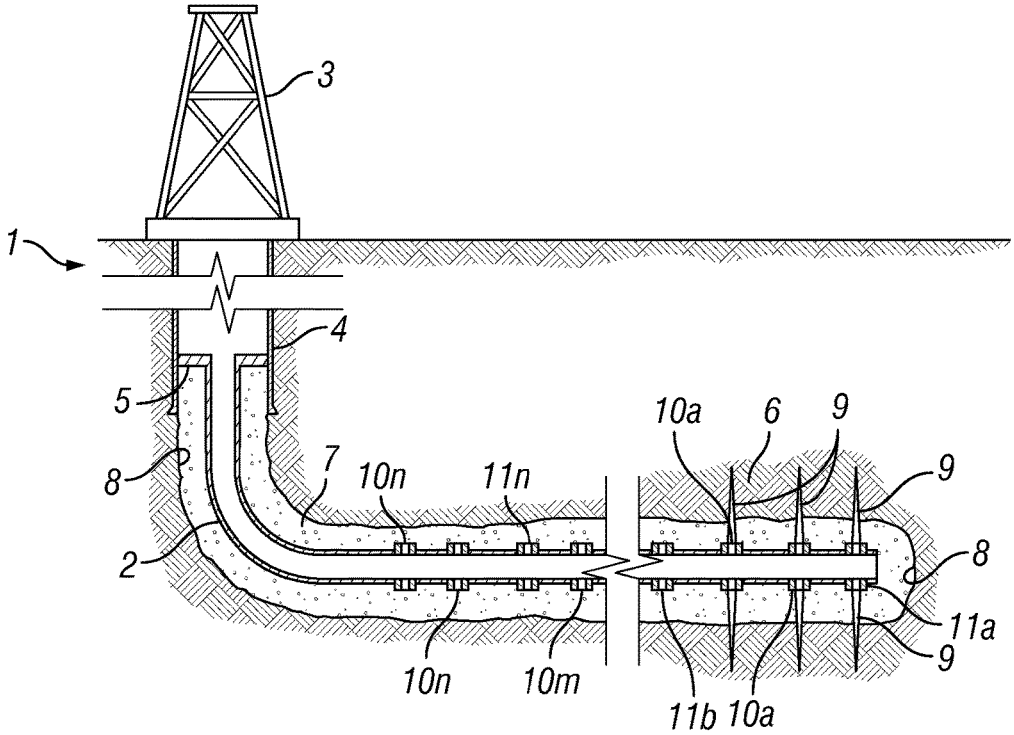
FIG. 1A is a schematic illustration of a preferred embodiment 2 of the tubular assemblies of the subject invention showing an initial stage of a frac job in which three clustered zones 9 have been fractured simultaneously.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to valves used in oil and gas well operations and especially to stimulation valves used in completing oil and gas wells. Broader embodiments of the novel valves comprise a cylindrical housing, a valve body, and an actuation seat. The housing is adapted for assembly into a tubular string such as a liner for a well. The valve housing defines a conduit for the passage of fluids through the housing and has one or more ports which can allow fluids to pass from the conduit to the exterior of the valve. The ports may be shut off or left open by the valve body.

The actuation seat is mounted in the valve conduit above the ports. The actuation seat has an initial "ball-catch" state in which a ball may land on the actuation seat and substantially restrict the flow of fluids through the conduit. The actuation seat is operatively connected to the valve body such that when hydraulic pressure is applied above a seated ball, the valve body will be moved from a closed position shutting off flow through the ports to an open position allowing flow through the ports. The actuation seat is adapted to transition from its ball-catch state to a "ball-pass" state as the valve body moves to open the ports, thus allowing a seated ball to be released from the actuation seat.

For example, a first preferred frac valve 10 is illustrated in FIGS. 1-4. Frac valve 10 is a cluster frac valve. That is, it is a valve that is intended to be clustered with a static valve and, if desired, additional cluster valves, so as to allow multiple zones to be fractured in a single stage. Thus, as may be seen in the schematic representations of FIG. 1, a number of cluster frac valves 10 and a number of static frac valves 11 may be incorporated into production liner 2 which forms part of a typical oil and gas well 1. Well 1 is serviced by a derrick 3 and various other surface equipment (not shown). The upper portion of well 1 is provided with a casing 4. Production liner 2 has been installed in the lower portion of casing 4 via a liner hanger 5. It will be noted that the lower part of well 1 extends generally horizontally through a hydrocarbon bearing formation 6 and that liner 2 has been cemented in place. That is, cement 7 has been introduced into the annular space between liner 2 and the well bore 8.

Figure 1B:
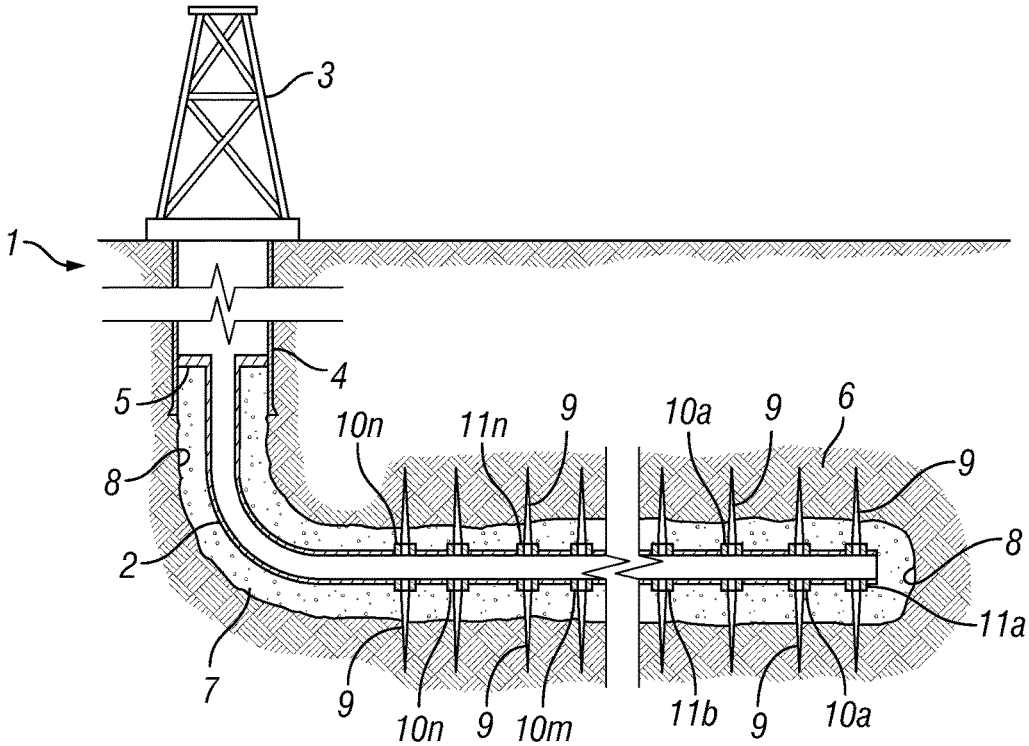
FIG. 1B is a schematic illustration of novel liner assembly 2 shown in FIG. 1A showing completion of the frac job.

As discussed in greater detail below, a typical frac job will generally proceed from the lowermost zone in a well to the uppermost zone. The zones may be fractured individually, or multiple zones may be clustered and fractured simultaneously in a single stage. FIG. 1A, therefore, shows the well bore after the initial stage has been completed. Fractures 9 have been established adjacent a static valve 11*a* and adjacent cluster valves 10*a* in the first three zones near the bottom of well 1. Zones further uphole in well 1 will be fractured in successive stages until, as shown in FIG. 1B, all stages of the frac job have been completed and fractures 9 have been established in all zones. It also will be noted that production liner 2 is shown only in part as such liners may extend for a substantial distance. The portion of liner 2 not shown also will incorporate a number of valves 10 and 11, and well 1 will be provided with additional fractures 9 in the areas not shown in FIG. 1.

Figure 2A:
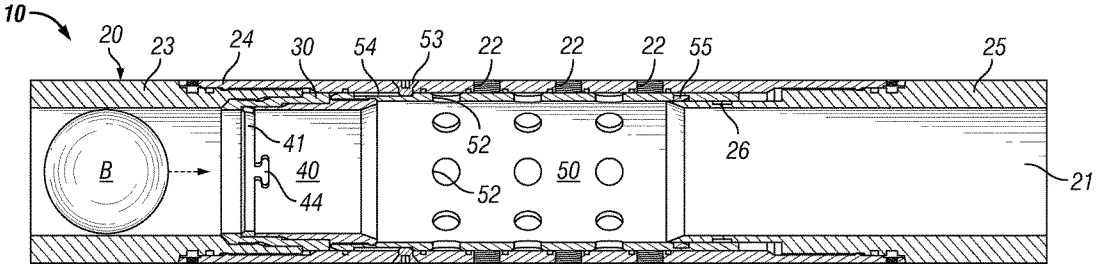
FIG. 2A is an axial cross-sectional view of a preferred embodiment 10 of the stimulation valves of the subject invention showing cluster frac valve 10 in its closed or run-in position.
Figure 2B:
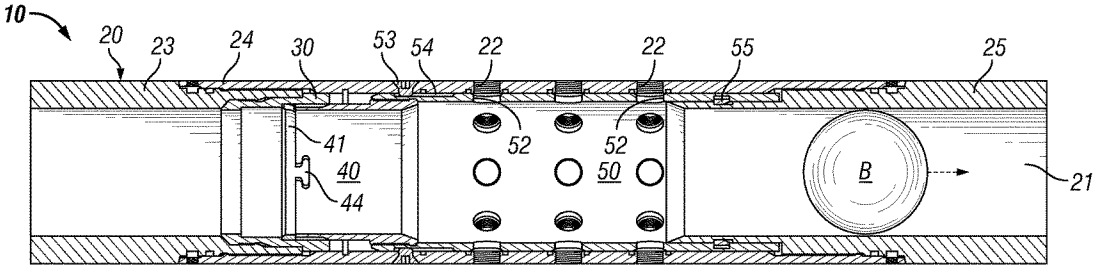
FIG. 2B is an axial cross-sectional view similar to the view of FIG. 2A showing novel cluster frac valve 10 in its open position.
Figure 3:
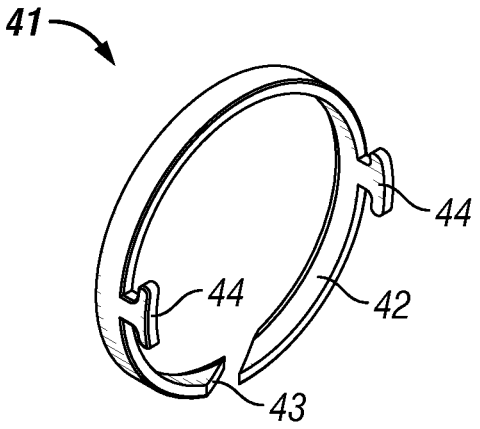
FIG. 3 is a perspective view of a preferred ball seat 41 incorporated into novel cluster frac valve 10.
Figure 4:
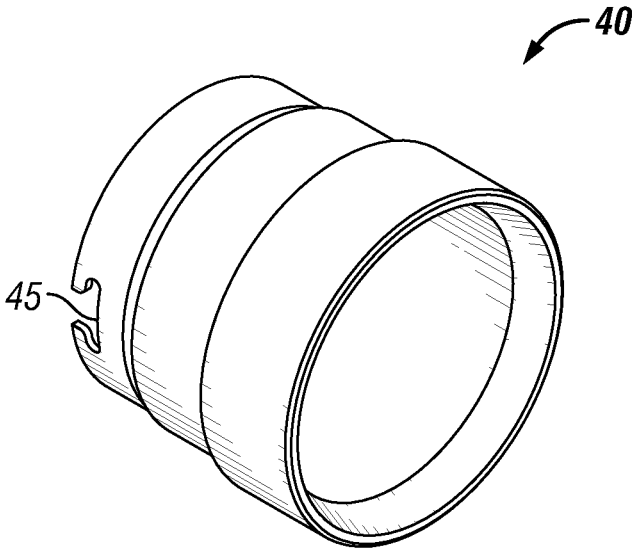
FIG. 4 is a perspective view of a preferred drive sleeve 40 incorporated into novel cluster frac valve 10.

Preferred novel cluster frac valve 10 is shown in greater detail in FIGS. 2-4. As shown in overview in FIG. 2, cluster valve 10 generally comprises a housing 20, a restriction sleeve 30, an actuation ball seat 41, a drive sleeve 40, and a valve sleeve 50. Housing 20, as is typical of many downhole tools, is generally cylindrical and serves as the frame to which the other valve components are mounted, directly or indirectly. Housing 20 and other components collectively define an axial, central conduit 21 through which well fluids may pass. Housing 20 also has ports 22 which, when valve sleeve 50 is in an open position, allow fluid to pass from conduit 21 to the exterior of housing 20, as may be seen in FIG. 2B.

More particularly, housing 20 generally comprises an upper housing sub 23, an intermediate housing sub 24, and a lower housing sub 25, each of which are generally cylindrically shaped, tubular components. Subs 23, 24, and 25 are threaded together or otherwise assembled by means common in the art, such as threaded connections. Upper housing sub 23 and lower housing sub 25 also are adapted for assembly into liner joints and other tubulars. Thus, for example, the upper end of upper housing sub 23 and the lower end of lower housing sub 25 are provided with threads so that valve 10 may be threaded into production liner 2. The inner diameters of the lower portion of upper housing sub 23 and of intermediate housing sub 24 are generally enlarged somewhat relative to the inner diameter of the upper portions of upper housing sub 23 and lower housing sub 25 to accommodate the other valve components, such as drive sleeve 40 and valve sleeve 50.

The housing of the novel valves has one or more ports therein that allows passage of well fluids. Preferably, as in preferred cluster valve 10 and seen best in FIG. 2, they are provided with a plurality of ports, such as flow ports 22. Flow ports 22 may be arranged radially around a portion of intermediate housing sub 24. It will be noted that intermediate housing sub 24 includes three longitudinally spaced sets of radially arranged ports 22. The precise number and arrangement of flow ports 22, however, and their cross section, in general are not critical to practicing the invention. They may be varied as desired to provide whatever flow capacity or pattern as may be desired for the novel valves.

The actuation seat has an initial ball-catch state in which it will receive a ball to allow the valve to be opened and a ball-pass state in which a seated ball may be released and allowed to exit the valve. In some embodiments, the ball seat will catch and release a ball to actuate a drive sleeve which in turn is adapted to engage and drive the valve body such that the valve body moves from its closed position to its open position.

For example, in cluster valve 10 actuation ball seat 41 is mounted on the upper end of drive sleeve 40 near the upper portion of valve 10 and above ports 22, as may be seen in FIG. 2. Drive sleeve 40 is a generally cylindrical sleeve mounted for linear movement within housing 20. More particularly, it will be noted that drive sleeve 40 is mounted generally within an enlarged diameter lower portion of upper housing sub 23 and the upper portion of intermediate housing sub 24. Preferably, as in valve 10, the inner diameter of drive sleeve 40 is the same as or closely approximates the inner diameter of upper housing sub 23 and lower housing sub 25.

The actuation seat of the novel stimulation valves is adapted to catch and release balls pumped into the valve so as to allow actuation of the valve sleeve in multiple valves with a single ball. Thus, for example, actuation ball seat 41 in cluster valve 10 is a split ring having tapered upper portions. As seen best in FIG. 3, it has a discontinuous annular body 42, the body being discontinuous in the sense that a gap 43 is provided therein. Gap 43 allows body 42 of actuation seat 41 to be radially compressed. When compressed, gap 43 preferably is closed allowing body 42 to form a continuous seat. Body 42 of actuation seat 41 preferably is configured to provide a gap 43 which angles through body 42 instead of directly across it. Angled gap 43 allows the creation of a more effective seal when body 42 is compressed into a continuous seat.

In any event, by providing gap 43 in body 42, actuation seat 41 can be compressed to receive a ball of a defined diameter that would pass through actuation seat 41 in its expanded state. When drive sleeve 40 is in its initial upward position as shown, for example, in FIG. 2A, actuation seat 41 is radially compressed within an enlarged diameter portion of restriction sleeve 30 near the upper end thereof. Being in its compressed state, actuation seat 41 will catch a ball pumped into valve 10, such as ball B.

Continued pumping of fluid into liner 2 will create hydraulic pressure above ball B which urges drive sleeve 40 downward relative to housing 20. Drive sleeve in turn urges valve sleeve 50 downward into its open position to allow flow through ports 22. After drive sleeve 40 has travelled downward a distance sufficient to move valve sleeve 50 to its open position, actuation seat 41 will enter another, further enlarged portion of restriction sleeve 30 and will relax and expand as shown, for example, in FIG. 2B. Once it has expanded, ball seat 41 will release ball B, allowing ball B to pass through valve 10 and continue traveling down through liner 2, as shown in FIG. 2B.

Ball seat 41 may be mounted within valve 10 such that it is always under a certain degree of compression, even in positions where it is described as relaxed and expanded. It will be understood that references to compressed states or positions, therefore, typically will references states of increased compression relative to states or positions where they may be more relaxed, more expanded, and less compressed, and not necessarily to states where they are under no compression.

As shown in FIGS. 2-4, actuation seat 41 is provided with a downwardly extending, generally t-shaped tab 44 which is disposed in a corresponding cut-out 45 provided in drive sleeve 40. Actuation seat 41 preferably is mounted on drive sleeve 40 under some compression so that tab 44, once placed therein, will tend to remain in cut-out 45. Cut-out 45 it also will be noted is somewhat enlarged relative to t-shaped tab 44 so as to allow tab 44 to shift sideways therein. The interlock between tab 44 and cut-out 45 thus provides a secure connection between actuation seat 41 and drive sleeve 40, yet allows actuation seat to expand and release a seated ball. Relative axial movement between actuation seat 41 and drive sleeve 40 is restricted. As discussed below, that engagement also rotationally locks actuation seat 41 to drive sleeve 40.

The compressible, split rings used to provide actuation seat 41 in valve 10 provide a simple, effective mechanism for allowing the selective catch and release of a ball. They also provide an effective seat which allows a captured ball to substantially shut off flow through the seat, which in turn allows hydraulic force to be efficiently created and effectively transferred to a drive member. Any number of similar mechanisms, however, may be used to provide such a ball seat in the novel valves.

A plurality of radially displaceable ring segments or dogs may be used and mounted, for example, in suitably configured slots in drive sleeve 40. Such segments and dogs would be mounted such that they are urged inward when drive sleeve 40 is in its upper, initial position, and allowed to be displaced outward when drive sleeve 40 has completed its down stroke. Drive sleeve 40 also may be provided with resilient collet fingers that could be compressed to capture a ball and allowed to relax to pass a ball. A ball seat formed of resilient material also may be provided. The resilient material would be selected and molded so as to capture a ball, hold it while sufficient hydraulic force is generated to actuate drive sleeve, and then release it at higher hydraulic pressures.

It also will be appreciated that the description references drop balls. Spherical balls are preferred, as they generally will be transported though well tubulars and into engagement with downhole components with greater reliability. Other conventional plugs, darts, and the like which do not have a spherical shape, however, also may be used to index and actuate the novel valves. The configuration of the "ball" seats necessarily would be coordinated with the geometry of such devices. "Balls" as used herein, therefore, will be understood to include any of the various conventional plug and actuating devices that are commonly deployed into a well to mechanically actuate mechanisms, even if such devices are not spherical. "Ball" seats is used in a similar manner.

The valve body of the novel stimulation valves is adapted to shut off or to allow fluid flow through the ports in the valve housing. Thus, for example, valve sleeve 50 in valve 10 is a generally cylindrical sleeve mounted within intermediate housing sub 24, as may be seen in FIG. 2. As shown therein, valve sleeve 50 has a number of ports 52. The arrangement and size of ports 52 are generally coordinated with ports 22 in intermediate housing sub 24. Thus, valve sleeve 50 is provided with three longitudinally spaced sets of radially arranged ports 52.

When valve sleeve 50 is in its initial, run-in position as shown in FIG. 2A, valve ports 52 are offset from flow ports 22 in intermediate housing sub 24. Fluid flow between central conduit 21 to the exterior of housing 20 is shut off. When ball B is deployed into valve 10 as shown in FIG. 2A, drive sleeve 40 is in its upper position and actuation ball seat 41 is compressed. Ball B, therefore, will land on actuation seat 41, urging drive sleeve 40 axially downward, that is, downward in a path generally parallel to the central axis of valve 10. As drive sleeve 40 moves through its down stroke, drive sleeve 40 engages and drives valve sleeve 50 downward. As valve sleeve 50 is driven down, ports 52 in valve sleeve 50 align with flow ports 22 in intermediate housing sub 24. Fluids may thereafter flow from central conduit 21 through ports 22 and 52 to the exterior of valve 10.

Once they are opened, the novel valves preferably will stay open to allow hydrocarbons to flow from the formation into the liner once fracturing has been completed and the well is ready for production. For example, valve 10 is provided with a split lock-ring 55 which is initially disposed in a somewhat expanded state in a groove in the inner surface of the lower end of valve sleeve 50. As valve sleeve 50 completes its down stroke, lock-ring 55 will align with a groove 26 in lower housing sub 25 and expand partially out of the groove in valve sleeve 50 and into groove 26. That engagement between lock-ring 55, the groove in valve sleeve 50, and groove 26 will hold valve sleeve 50 in its lower, open position, thus ensuring that once fracturing is completed, hydrocarbons flowing from the formation will be able to pass through ports 22 and 52 and flow up liner 2 to the surface.

While lock-ring 55 provides a simple, effective mechanism for preventing valve sleeve 50 from moving back to its closed position and ensuring that valve 10 remains open, other mechanisms may be incorporated into the novel valves to reduce the likelihood that the valve sleeve will move out of its open position. For example, a lock-ring could be mounted in the housing under compression and then expand out into a groove in inner surface of the valve sleeve. A ratchet ring may be disposed in a groove on the outer surface of the valve sleeve and mating detents provided on the inner surface of the valve housing, or vice versa, to preclude movement of valve sleeve back toward its closed position once it has been opened. The lower end of valve sleeve also may be configured to shoulder out on a stop provided on the valve housing. Dogs or collet mechanisms also may be provided on the valve sleeve or in the valve housing such that the dogs or flexible fingers latch into grooves or recesses and restrict relative movement between the valve sleeve and the valve housing.

Given the connection between actuation ball seat 41, drive sleeve 40, and valve sleeve 50, locking of valve sleeve 50 in its open position also precludes axial movement of actuation seat 41 and holds it in its expanded state. That ensures that the balls used to actuate valve 10 during fracturing are able to travel back through valve 10 as production fluids flow upward through liner 2. Other mechanisms for ensuring that actuation seat 41 remains in its expanded, ball-pass state, however, may be used if desired. For example, the inner surface of restriction sleeve 30 may be provided with a groove, and actuation seat 41 may be allowed to expand into the groove.

It will be appreciated that the hydraulic pressures and flow rates employed during fracturing operations are quite high. Upstream valves, which are not yet opened, will be subjected to those pressures and flow rates as valves further downhole in the liner are opened and their adjacent zones are fractured. Such pressures and flow rates may create a compressive force on actuation seat 41 which could cause it to disengage from drive sleeve 40. If that were to occur, actuation seat 41 could be dislodged down into valve 10, and it might not be possible to open valve 10 with a drop ball.

Valve 10, therefore, preferably is provided with a restriction above actuation ball seat 41, such as provided by restriction sleeve 30. Restriction sleeve 30 presents a restriction in central conduit 21 of valve 10 immediately above actuation seat 41. While having a somewhat larger inner diameter than that of actuation seat 41, restriction sleeve 30 nevertheless covers all or a substantial portion of the flat upper surface of actuation seat 41. Restriction sleeve 30, therefore, effectively shields actuation seat 41 from a substantial portion of the hydraulic pressure created as fluid is forced to flow through the restriction created by actuation seat 41 and diminishes the likelihood that actuation seat 41 will be compressed and dislodged from drive sleeve 40.

After the fracturing operation is complete, an operator may want to enhance the flow capacity of a liner to allow greater production of hydrocarbons through the liner. Thus, restriction sleeve 30 and actuation seat 41 preferably are fabricated from materials that are more easily drilled out than the relatively hard steel alloys typically used to fabricate downhole tool components. Such drillable materials include softer metals and alloys such as cast iron and aluminum. More preferably, however, they include even more easily drilled materials such as polyurethane or composite materials, the latter including filament wound, fiberglass cloth wound, and molded fiberglass composites employing epoxy, phenolic, polyamide or other common resins.

A liner will be drilled out typically by a rotating bit or auger. To the extent that components to be drilled out are allowed to rotate with a bit, the drilling out process will be less effective and more time consuming. Preferably, therefore, restriction sleeve 30 and actuation seat 41 are rotationally locked relative to housing 20, as are the other components of valve 10. It will be appreciated, however, that a drill bit or auger will be rotated in a clockwise direction so as to avoid unthreading the joints of a liner assembly. Thus, by "rotational locking" it will be understood to include precluding rotation in a clockwise direction as well as rotation in both directions.

For example, in valve 10 restriction sleeve 30 is threaded into the lower end of upper housing sub 23 by reverse threads. Any rotating auger passing through valve 10, therefore, will only tighten the connection between restriction sleeve 30 and upper housing sub 23. Restriction sleeve 30 will be precluded from rotating with the auger and may be drilled out more efficiently regardless of the material from which it is made.

Valve sleeve 50, drive sleeve 40, and actuation ball seat 41 also are preferably rotationally locked relative to housing 20. For example, valve sleeve 50 is rotationally locked to intermediate housing sub 24 by screws 53 which extend through threaded openings in intermediate housing sub 24 and terminate in axial slots 54 provided in the exterior surface of the upper portion of valve sleeve 50. Screws 53, therefore, allow axial movement of valve sleeve 50, but prevent valve sleeve 50 from rotating in either direction relative to intermediate housing sub 24. Alternately, mating castellation (not shown) may be provided at the lower end of valve sleeve 50 and the upper end of lower housing sub 25 to rotationally lock valve sleeve 50 to lower housing sub 25, yet allow axial movement of valve sleeve 50 within housing 20.

Drive sleeve 40 is in turn rotationally locked to valve sleeve 50 by any number of mechanisms such as pins, screws, castellation, or, as in cluster valve 10, reverse threads. Actuation seat 41 preferably is rotationally locked relative to housing 20, for example, by rotationally locking it to drive sleeve 40 via the engagement of tab 44 in cut-out 45 of drive sleeve 40. Other profiles extending axially or radially from body 42 of actuation seat 41 also may be provided to mechanically bear on or interfere with housing 20 or with other rotationally locked components of valve 10. For example, body 42 may be provided with downwardly extending castellation or other profiles that will interfere with similar castellation or profiles extending upwardly from the upper end of drive sleeve 40 for similar effect. Actuation seat 41 also may be provided with fins extending radially outward from and along the outer surface of body 42, the fins being designed to interfere with slots or grooves extending axially along the inner surface of restriction sleeve 30. When actuation seat 41 is designed to move axially along with another valve component, such as drive sleeve 40, the profiles preferably, as do tab 44 and cut-out 45, restrict relative axial movement between the components.

Static frac valve 11 is an example of a second preferred embodiment of the novel frac valves. Static valve 11 is designed and constructed substantially the same as cluster valve 10 except that it comprises an isolation seat mounted within valve 11 below flow ports 22. Isolation seat is configured to capture a ball deployed into valve 11. The ball will be caught by the actuation seat 41 in valve 11 to open flow ports 22 in valve 11 and then released, allowing it to seat on the isolation seat. Once seated thereon, the ball will substantially shut off fluid flow through valve 11 to lower portions of liner 2, substantially isolating any downhole valves 10 and 11 from fluid pumped into liner 2 and forcing fluid out flow ports 22 of static valve 11 and the opened cluster valves 10 above it. If the isolation seat likely will be drilled out after completion of a fracturing operation, like actuation seat 41, it also preferably is fabricated from softer, more drillable materials.

For example, the isolation seat may comprise a split ring which is adapted for compression by valve sleeve 50 as it is moved to its open position. The isolation seat would transition from a clearance at least as large as the initial clearance through actuation ball seat 41 to a clearance sufficient to receive a ball released by actuation ball seat 41 and providing sufficient load capacity for isolating downhole portions of liner 2. The isolation seat then may be adapted for upward displacement into areas of enlarged diameter by balls backflowed through the valve with production fluids flowing. Displacement of the isolation seat would allow it to relax and expand and allow backflow of balls through valve 11. Such mechanisms for setting and displacing isolation seats are disclosed in applicant's co-pending applications, U.S. Ser. No. 13/987,053, filed Jun. 28, 2013, and U.S. Ser. No. 14/229,362, filed Mar. 28, 2014, the disclosures of which are incorporated herein in their entirety.

As noted above, the advantages derived from the novel valves perhaps are best appreciated in the context of large, multi-stage fracking operations. Embodiments of the subject invention, therefore, also are directed to methods of fracturing formations in a well bore using the novel frac valves.

A typical multi-stage fracking operation will start by making up a production liner containing a series of valves. The novel valves make it possible to incorporate a relatively large number of valves into a production liner or other tubular and, therefore, to fracture a formation in a relatively large number of zones. Thus, as will be appreciated from FIG. 1, a number of cluster valves 10 and static valves 11 may be incorporated into production liner 2 just upstream of an initiator valve (not shown) situated in production liner 2 near the toe of well bore 8. The valves are grouped into a series of clustered valves including one or more cluster valves 10 and a static valve 11. For example, as shown in FIG. 1, liner 2 includes clustered valves 10*a* and 11*a* to 10*n* and 11*n* (not all of which are shown), each set of clustered valves including two cluster valves 10 and a static valve 11.

The actuation ball seat 41 in the first set of clustered valves 10*a* and 11*a* all are the same size, so that cluster valves 10*a* and static valve 11*a* may be actuated by balls of the same size. Likewise, the isolation seat in static valve 11*a* has substantially the same size. Cluster valves 10*b* and static valve 11*b* also share a common-sized actuation seat 41, but the actuation seats 41 in cluster valves 10*b* and static valve 11*b* and the isolation seat in static valve 11*b* are sized to catch and release or to catch, respectively, a slightly larger ball than that which is used to actuate valves 10*a* and 11*a*. The other sets of clustered valves are similarly configured to share common-sized seats, with cluster valves 10*n* and static valve 11*n* having the largest seats among the sets of clustered valves 10 and 11.

Liner 2 then may be run into a well bore and installed near the lower end of host casing 4, for example, by a liner hanger 5. Valves 10 and 11 will be in their closed, run in position. If the frac job will be performed on an open hole, the production liner also will incorporate a series of packers that will be set to seal off and isolate various zones in the well bore. If not, the liner will be cemented in place by pumping a plug of cement down the production liner, out the bottom of the liner, and into the annulus between the liner and well bore. The cement will be allowed to harden and encase the liner, for example, as shown in FIG. 1, where cement 7 has encased production liner 2.

Installing a liner or other well tubular with the novel frac valves may be performed by conventional methods and utilizing any number of widely available tools and supplies as are used in installing conventional liners and tubulars. Conventional static valves also may be used with novel cluster valves, and vice versa. Many such designs are known and are commercially available. The novel valves typically will not be used as initiator valves, but may be when a ball may be deployed into the valve without pumping. Otherwise, a wide variety of conventional initiator valves are known and may be used with the novel valves in a liner assembly.

In any event, once liner 2 has been installed, hydraulic pressure will be increased in production liner 2 to open the initiator frac valve, fracture the first zone near the toe of well bore 8, and to established flow into production liner 2. Cluster valves 10 and static valves 11 then may be actuated by deploying balls through production liner 2. More specifically, a first ball B is deployed into production liner 2. Since it is too small to be captured in actuation seat 41 of the upper sets of clustered valves (valves 10*n* and 11*n* to valves 10*b* and 11*b*), it will pass through those valves without actuating them. As it continues down production liner 2, however, it first lands on actuation seat 41 of upper cluster valve 10*a*, allowing ports 22 therein to be opened. Actuation seat 41 in upper cluster valve 10*a* then will release first ball B, allowing it to continue down liner 2. First ball B then will land on actuation seat 41 of the lower cluster valve 10*a*, allowing ports 22 therein to be opened. First ball B then will be released, and it will travel down into static valve 11*b* and open ports 22 therein. It then will come to rest on the isolation seat in static valve 11*b*.

At this point, ports 22 in cluster valves 10*a* and static valve Ha are all opened. The zones adjacent valves 10*a* and 11*a* then can be fractured simultaneously. Once that stage is complete, a second, slightly larger ball B will be deployed to open clustered valves 10*b* and 11*b*. The zones adjacent those valves 10*b* and 11*b* then will be fractured simultaneously. Successively larger balls B then will be deployed to complete all stages and to fracture the zones adjacent clustered valves 10*c* and 11*c* to 10*n* and 11*n*.

Valves in a production liner will be designed to open above certain pressure thresholds, and operators typically will target flow rates and pressures which are intended to optimize fracturing of a formation. Thus, it is necessary, but not always easy to control the pumps at the surface to ensure that the proper amount of fluid is pumped into a liner. One complicating factor arises from opening the valves, especially a set of clustered valves.

When top cluster valve 10*a* is opened, for example, hydraulic fluid is able to flow out liner 2 via ports 22. To the extent that fluid is diverted out of liner 2, and absent adjustment of pump rates, hydraulic pressure in liner 2 will drop. Since actuation seat 41 is located above flow ports 22, however, any such pressure drop cannot complicate or prevent complete opening of top cluster valve 10*a*. That is, any such pressure drop will occur only after valve sleeve 50 has been driven downward and flow ports 22 have been fully opened.

Similarly, while bottom cluster valve 10*a* may experience a pressure drop due to the opening of top cluster valve 10*a*, it will not experience any pressure drop associated with it being opened. Any pressure drop caused by opening bottom cluster valve 10*a* will only occur after it has been completely opened. Static valve 11*b* also will not experience any pressure drop associated with its opening. Actuation seat 41 in static valve 11*b* also is located above flow ports 22. Thus, each valve 10*a* and 11*a* downhole in the cluster will experience less of pressure drop and the likelihood that they will not be completely opened will be diminished.

Once fracturing of the formation has been completed, and especially if valves in the production liner have relatively small ball seats presenting significant restrictions in the liner, operators may desire to drill out the liner. Various embodiments of the novel ball seats and valves may greatly improve the efficiency of drill out operations. For example, restriction sleeve 30 and actuation seat 41 of cluster valve 10 preferably are fabricated from softer, more drillable materials and are rotationally locked relative to housing 20.

It will be appreciated, therefore, that while they may be used in wells where only a few zones will be fractured, the novel frac valves are particularly suited for incorporation into production liners or other tubulars where a large number of zones will be fractured in multiple stages. As described above, three zones may be fractured in a single stage, and a single liner may allow for a number of stages by coordinating the relative size of the actuation seats in each set of clustered valves. Additional cluster valves may be provided in each set of clustered valves, however, to allow even more zones to be fractured. Each set of clustered valves may be provided with the same, or a different number of cluster valves. Thus, the novel valves not only allow fracturing to proceed over an extended distance in a large number of zones, but they allow great flexibility in fracturing the well.

It will be appreciated that valves 10 and 11 and other embodiments of the novel valves typically will incorporate various shear screws, wires, and the like to immobilize components during assembly, shipping, or run-in of the valve. Shear screws, for example, typically will be employed to immobilize the drive sleeve or valve sleeve of valves 10 and 11. O-rings, for example, may be provided between housing subs and around flow ports to provide pressure tight connections. Such features are shown to a certain degree in the figures, but their design and use in tools such as the novel valves is well known and well within the skill of workers in the art. In large part, therefore, discussion of such features is omitted from this description of preferred embodiments.

The various valves 10 and 11 have been described as being incorporated into a liner and, more specifically, a production liner used to fracture a well in various zones along the well bore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. It is, in essence, a "casing" that does not extend from the surface. "Tubing" refers to a smaller tubular conduit, usually less that 4.5" in diameter. The novel valves, however, are not limited in their application to liners as that term may be understood in its narrow sense. They may be used to advantage in liners, casings, tubing, and other tubular conduits or "tubulars" as are commonly employed in oil and gas wells.

Likewise, while the exemplified valves are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled in the vicinity of a "production" well. Water or other fluids then would be injected into the formation through the stimulation wells to drive hydrocarbons toward the production well. The novel valves may be used in all such stimulation processes where it may be desirable to create and control fluid flow in defined zones through a well bore. Though fracturing a well bore is a common and important stimulation process, the novel valves are not limited thereto.

Exemplified valves 10 and 11 have been disclosed and described as being assembled from a number of separate components. Workers in the art will appreciate that certain of those components and other tool components may be fabricated as separate components, or may be combined and fabricated as a single component if desired. For example, housing 20 in valve 10 is assembled from three major components, but upper housing sub 23 and intermediate housing sub 24 could be fabricated as a single component. Similarly, drive sleeve 40 and valve sleeve 50 are separate components, but could be single component. Restriction sleeve 30 also could be fabricated with upper housing sub 23 as a single component. Other modifications of this type are within the skill of workers in the art and may be made to facilitate fabrication, assembly, or servicing of the valves or to enhance its adaptability in the field.

Otherwise, the valves of the subject invention may be made of materials and by methods commonly employed in the manufacture of oil well tools in general and valves in particular. Typically, the various major components will be machined from relatively hard, high yield steel and other ferrous alloys by techniques commonly employed for tools of this type. As noted above, however, components may also be made of somewhat softer, more easily drilled materials where the component will be drilled out after completion of a stimulation operation.

It also will be appreciated that rotationally locked, catch and release ball seats, such as exemplified by actuation ball seat 41, may be useful in other downhole tools employing catch and release ball seats. They may be used, for example, in indexing ball-drop valves, as exemplified by the indexing ball-drop valves disclosed in applicant's U.S. priority patent application Ser. No. 13/987,053, filed Jun. 28, 2013, the disclosure of which is incorporated herein by reference. Various other downhole tools employ ball seats, and may incorporate ball seats that must selectively capture a ball or allow it to pass. Such tools include cement diverters, circulation diverters, and surge diverters. The novel, rotationally locked, catch and release ball seats disclosed herein may be used to advantage in such tools as well.

While this invention has been disclosed and discussed primarily in terms of specific embodiments thereof, it is not intended to be limited thereto. Other modifications and embodiments will be apparent to the worker in the art.

What is claimed is:

1. A stimulation valve for a well tubular, said stimulation valve comprising:

a cylindrical housing adapted for assembly into a tubular for a well and defining a conduit for passage of fluids through said housing and one or more ports allowing fluid communication between said conduit and the exterior of said housing;

a valve body adapted for movement from a closed position restricting fluid communication through said ports to an open position allowing fluid communication through said ports;

a drive sleeve positioned within the conduit; and a ball seat comprising a split ring having an annular body and an empty gap formed between two circumferential ends thereof, the ball seat being mounted in said drive sleeve above said ports, said ball seat having an initial ball-catch state and being operatively connected to said valve body, wherein the ball seat is configured to receive a ball, and wherein the ball seat receiving the ball causes said valve body to move from its closed position to its open position;

wherein said ball seat is adapted to transition to a ball-pass state as said valve body is moved from said closed position to said open position, and wherein said ball seat in the ball-pass state is configured to release said ball after said valve body has moved to its open position;

wherein said split ring comprises a tab engaging the drive sleeve such that interference between said tab and said drive sleeve restricts said split ring from rotating relative to said drive sleeve; and wherein said tab has a first portion extending in a first direction so as to restrict rotation of said split ring relative to the drive sleeve and a second portion extending in a second direction to restrict axial movement of said split ring relative to the drive sleeve.

2. The stimulation valve of claim 1, wherein said ball seat is mounted in said tool to restrict rotation of said ball seat relative to said tool.

3. The stimulation valve of claim 1, wherein said split ring is expanded outward from the ball-catch state when transitioned into said ball-pass state.

4. The stimulation valve of claim 1, wherein said circumferential ends are closer together in the ball-catch state than in the ball-pass state, such that the gap is nearly closed when said split ring is in said ball-catch state.

5. The stimulation valve of claim 1, wherein said split ring is mounted in said drive sleeve to restrict rotation of said split ring relative to said housing.

6. The stimulation valve of claim 1, wherein said ball seat is mounted for axial movement from a first position corresponding to said ball-catch state to a second position corresponding to said ball-pass state and is operably connected to said valve body such that when said ball seat moves to said second position said valve body moves to said open position.

7. The stimulation valve of claim 1, wherein said valve has an area of reduced diameter and an area of enlarged diameter and said split ring is mounted for axial movement from said area of reduced diameter to said area of enlarged diameter, whereby said split ring is expanded when moved into said area of enlarged diameter to place said split ring in said ball-pass state.

8. The stimulation valve of claim 7, wherein said drive sleeve is configured to move axially relative to the housing, and engage said valve body in response to a pressure applied to the ball caught in the ball seat, so as to transmit an axial force from the ball, through the ball seat and the drive sleeve, and to the valve body, such that the valve body is moved axially relative to the housing, from the closed position to the open position.

9. The stimulation valve of claim 1, wherein said drive sleeve is mounted for axial movement from a first position to a second position and operably connected to said valve body such that when said drive sleeve moves to said second position said valve body moves to said open position, and wherein said movement of said drive sleeve to said second position allows said split ring to expand and release said ball.

10. The stimulation valve of claim 1, wherein said ball seat is fabricated from a drillable material.

11. The stimulation valve of claim 10, wherein said ball seat is fabricated from a molded fiberglass epoxy composite material.

12. The stimulation valve of claim 1, wherein said valve body is a sleeve.

13. The stimulation valve of claim 1, wherein said valve comprises a second ball seat mounted below said ports, said second ball seat being adapted to receive a ball to restrict fluid flow through said conduit.

14. A tubular adapted for installation in a well comprising the stimulation valve of claim 1.

15. A method of lining a well, the method comprising installing a tubular comprising the stimulation valve of claim 1.

16. A method of stimulating a formation in a well, said method comprising:

installing a tubular in said well, said tubular comprising an uphole stimulation valve and a downhole stimulation valve, said stimulation valves each comprising the stimulation valve of claim 1;

pumping a ball through said tubular to open both said stimulation valves;

pumping fluid through said tubular and out said opened stimulation valves to stimulate said formation adjacent both said stimulation valves simultaneously.

17. The method of claim 16, wherein said stimulation comprises fracturing said formation.

18. The stimulation valve of claim 1, wherein said stimulation valve lacks a second ball seat adapted to receive a ball for isolating portions of said tubular downhole of said stimulation valve from fluid pumped into said tubular assembly.

19. The stimulation valve of claim 1, wherein said ball seat is positioned uphole of the ports of the housing in the ball-catch state and in the ball-pass state.

20. A downhole tool, said tool being adapted for installation into a tubular assembly for a well and comprising:

a housing defining a conduit for passage of fluids through said tool;

a drive sleeve positioned within the conduit; and a ball seat mounted in said drive sleeve, said ball seat comprising a split ring defining an empty gap between two circumferential ends thereof, wherein said split ring comprises a tab engaging the drive sleeve such that interference between said tab and said drive sleeve restricts said split ring from rotating relative to said drive sleeve;

wherein said tab has a first portion extending in a first direction so as to restrict rotation of said split ring relative to the drive sleeve and a second portion extending in a second direction to restrict axial movement of said split ring relative to the drive sleeve;

wherein said split ring is configured to expand from a first state, in which said split ring provides a seat upon which a ball may be received to restrict passage of fluids through said conduit, to a second state, in which said split ring allows said ball to pass therethrough; and wherein said split ring is mounted in said tool to restrict rotation of said split ring relative to said housing.

21. The tool of claim 20, wherein the drive sleeve is slidable with respect to the housing, wherein said split ring comprises a profile adapted to bear on said drive sleeve and restrict rotation of said split ring relative to said drive sleeve when said split ring is subjected to rotational force.

22. The tool of claim 20, wherein said split ring fabricated from a drillable material.

23. The tool of claim 20, wherein the drive sleeve is coupled to the ball seat such that the ball seat is radially expandable relative to the drive sleeve, wherein:

the conduit comprises a first section and a second section, the first section defining a smaller diameter than the second section;

the drive sleeve is movable in the conduit relative to the housing from a first position to a second position, wherein the drive sleeve in the first position positions the ball seat in the first, smaller diameter section of the conduit, and the drive sleeve in the second position positions the ball seat in the second, larger diameter section; and the ball seat expands radially outwards when moved from the first section of the conduit to the second section of the conduit.

24. The tool of claim 23, further comprising a valve sleeve comprising a plurality of ports, the valve sleeve being movable axially, relative to the housing, from a closed position to an open position, wherein:

the housing comprises a plurality of ports, the ports of the valve sleeve being misaligned from the ports of the housing when the valve sleeve is in the closed position, and the ports of the valve sleeve being aligned with the ports of the housing when the valve sleeve is in the open position; and the drive sleeve engages the housing, such that the drive sleeve moving from the first position to the second position causes the valve sleeve to move axially from the closed position to the open position.

25. The tool of claim 23, wherein the housing comprises a restriction sleeve, the ball seat being positioned within the restriction sleeve when the ball seat is in the first state, such that the restriction sleeve shields at least a portion of the ball seat from fluid in the conduit, and wherein the restriction sleeve defines the first section of the conduit.

* * * * *